US010844747B2

(12) United States Patent
Bärow et al.

(10) Patent No.: US 10,844,747 B2
(45) Date of Patent: Nov. 24, 2020

(54) CONTINUOUS FLOW MACHINE HAVING MULTIPLE GUIDE VANE STAGES AND METHOD FOR PARTIALLY DISASSEMBLING A CONTINUOUS FLOW MACHINE OF THIS TYPE

(71) Applicant: Siemens Aktiengesellschaft, Munich (DE)

(72) Inventors: Stefan Bärow, Berlin (DE); Oliver Dominka, Oranienburg (DE); Guido Ederer, Berlin (DE); Christian Felsmann, Panketal (DE); Florian Fuchs, Berlin (DE); Robert Herfurth, Berlin (DE); Jose Angel Hernandez Maza, Berlin (DE); Michael Kluck, Berlin (DE); Eike Kohlhoff, Berlin (DE); Kay Krabiell, Hohen Neuendorf (DE); Khaled Maiz, Potsdam (DE); Behnam Nouri, Berlin (DE); Andre Willmann, Schildow (DE)

(73) Assignee: Siemens Aktiengesellschaft, Munich (DE)

( * ) Notice: Subject to any disclaimer, the term of this patent is extended or adjusted under 35 U.S.C. 154(b) by 151 days.

(21) Appl. No.: 16/079,620

(22) PCT Filed: Feb. 14, 2017

(86) PCT No.: PCT/EP2017/053226
§ 371 (c)(1),
(2) Date: Aug. 24, 2018

(87) PCT Pub. No.: WO2017/148695
PCT Pub. Date: Sep. 8, 2017

(65) Prior Publication Data

US 2019/0055856 A1 Feb. 21, 2019

(30) Foreign Application Priority Data

Mar. 4, 2016 (DE) ..... 10 2016 203 567

(51) Int. Cl.
*F01D 25/28* (2006.01)
*F01D 25/24* (2006.01)
*F01D 5/14* (2006.01)

(52) U.S. Cl.
CPC ..... *F01D 25/246* (2013.01); *F01D 5/147* (2013.01); *F01D 25/28* (2013.01); *F05D 2220/40* (2013.01); *F05D 2260/30* (2013.01)

(58) Field of Classification Search
CPC ..... F01D 25/24; F01D 25/243; F01D 25/28; F01D 5/147; F05D 2260/30
See application file for complete search history.

(56) References Cited

U.S. PATENT DOCUMENTS 2,910,269 A 10/1959 Lionel et al.
5,145,316 A 9/1992 Birch
(Continued)

FOREIGN PATENT DOCUMENTS

DE 112012006864 T5 5/2015
EP 1462616 A2 9/2004
(Continued)

OTHER PUBLICATIONS

International Search Report dated May 4, 2017, for PCT/EP2017/053226.
(Continued)

*Primary Examiner* — Kenneth J Hansen
*Assistant Examiner* — Maxime M Adjagbe
(74) *Attorney, Agent, or Firm* — Wolter VanDyke Davis, PLLC

(57) ABSTRACT

A continuous flow machine has at least one annular guide vane carrier. The guide vane carrier, formed at least by a lower part and an upper part detachably connected to same, has at least three guide vane stages retained on the inner circumference of the at least one guide vane carrier, arranged axially behind one another in the flow direction and each having a plurality of radially extending guide vanes. Each of the guide vanes also has a guide vane blade, a base plate and
(Continued)

a top plate, wherein the guide vane blade extends between the base plate and top plate. Via the arrangement of the securing pin in an intermediate space accessible in the assembled state, a partial disassembly of the individual guide vane stages is possible, independent of the remaining guide vane stages. The guide vane stages are conventionally mounted via retaining protrusions on neighbouring guide vane stages.

15 Claims, 5 Drawing Sheets

(56) References Cited

U.S. PATENT DOCUMENTS

| | | | | |
|---|---|---|---|---|
| 7,094,029 | B2 * | 8/2006 | Taylor | F01D 11/14 415/213.1 |
| 7,758,307 | B2 | 7/2010 | Van Heusden et al. | |
| 2007/0231133 | A1 | 10/2007 | Bart | |
| 2012/0134788 | A1 | 5/2012 | Taillant et al. | |
| 2014/0050567 | A1 * | 2/2014 | LeBlanc | F01D 17/162 415/148 |
| 2015/0022612 | A1 | 8/2015 | Taylor et al. | |
| 2015/0226075 | A1 | 8/2015 | Aoki et al. | |

FOREIGN PATENT DOCUMENTS

| | | | |
|---|---|---|---|
| GB | 2226365 | A | 6/1990 |
| GB | 2313161 | A | 11/1997 |
| RU | 2377421 | C2 | 12/2009 |

OTHER PUBLICATIONS

DE search report dated Dec. 5, 2016, for DE patent application No. 102016203567.3.

* cited by examiner

CONTINUOUS FLOW MACHINE HAVING MULTIPLE GUIDE VANE STAGES AND METHOD FOR PARTIALLY DISASSEMBLING A CONTINUOUS FLOW MACHINE OF THIS TYPE

CROSS REFERENCE TO RELATED APPLICATIONS

This application is the US National Stage of International Application No. PCT/EP2017/053226 filed Feb. 14, 2017, and claims the benefit thereof. The International Application claims the benefit of German Application No. DE 102016203567.3 filed Mar. 4, 2016. All of the applications are incorporated by reference herein in their entirety.

FIELD OF INVENTION

The present invention relates to a turbomachine having at least one guide vane carrier of ring-shaped form, which is composed at least of a lower part and an upper part which is connected releasably to the latter, and having at least three guide vane stages, which are retained on the inner circumference of the at least one guide vane carrier and are arranged axially one behind the other in the flow direction and each have a multiplicity of substantially radially extending guide vanes, wherein each guide vane comprises a guide vane airfoil, which extends between a root plate and a head plate, wherein each root plate is retained directly on the guide vane carrier in a form-fitting manner and, in this way, secured against displacement in the radial and axial directions, at least some root plates of guide vanes of each guide vane stage are secured against displacement in the circumferential direction by at least one additional securing element, the root plates of adjacently arranged guide vanes of axially adjacent guide vane stages in each case engage directly into one another in a form-fitting manner and partially overlap one another, and remaining between the root plates of each guide vane stage and the inner side of the guide vane carrier is in each case a substantially ring-shaped intermediate space which is accessible for the maintenance personnel in a maintenance state in which the lower part and the upper part of the guide vane carrier are separate from one another. The invention also relates to a method for partially disassembling a turbomachine, wherein the turbomachine has at least one guide vane carrier, which is composed at least of an upper part and a lower part, and has at least three guide vane stages of ring-shaped form, which are retained on the inner circumference of the guide vane carrier and are arranged axially one behind the other in the flow direction, in particular a turbomachine according to the invention, in which the upper part of the guide vane carrier is removed and guide vanes of a single guide vane stage are dismounted from the guide vane carrier.

BACKGROUND OF INVENTION

Turbomachines of the type mentioned in the introduction are basically known in the prior art. FIGS. 1 and 2 show, by way of example, the structure of a sub-region of a Siemens AG turbomachine 1 with a guide vane carrier 2 which is of ring-shaped form and which is subdivided centrally into an upper part and a lower part, wherein a section through the lower part 3 without a rotor is illustrated in FIG. 1. In the present case, in total four guide vane stages 4*a* to 4*d*, which are arranged axially one behind the other in the flow direction, are retained on the inner circumference of the guide vane carrier 2. Here, the guide vane stage 4*a* on the far left in FIG. 1 forms the first stage, and the guide vane stage 4*d* on the far right in FIG. 1 forms the fourth stage. Each guide vane stage 4*a* to 4*d* has a multiplicity of substantially radially extending guide vanes 5 whose guide vane airfoils 6 extend between root plates 7 arranged in a ring-shaped manner and head plates 8 arranged in a ring-shaped manner. The root plates 7 each comprise first retaining projections 9*a* projecting in the axial direction, which engage into ring-shaped grooves 10*a* formed on the guide vane carrier 2 and which secure the guide vanes 5 in the radial direction. More specifically, the root plates 7 of the guide vanes 5 of the first three guide vane stages 4*a*, 4*b* and 4*c* are each provided at one side with first retaining projections 9 via which one-sided support of the root plates 7 at the guide vane carrier 2 is realized. By contrast, first retaining projections 9*a* are formed on both sides at the root plates 7 of the guide vanes 5 of the fourth guide vane stage 4*d*, with the result that these root plates 7 are, on both sides, supported on the guide vane carrier 2 or fixed thereto. Furthermore, the root plates 7 each comprise second retaining projections 9*b* projecting in the axial direction, which engage into ring-shaped grooves 10*b* formed on the guide vane carrier 2 and which secure the guide vanes 5 in the axial direction, wherein in the present case, the second retaining projections 9*b* are each arranged directly adjacent to first retaining projections 9*a*. In order to prevent a movement of the root plates 7 relative to the guide vane carrier 2 in the circumferential direction, there are furthermore provided securing elements 11, in the form of securing pins, which are arranged in bores 12 which extend radially both through a first retaining projection 9*a* and through the guide vane carrier 2. The mutually facing axial end regions of the root plates of the guide vanes of adjacent guide vane stages are each provided with axially projecting overlapping projections 13 which overlap one another such that the root plates 7 of the first guide vane stage 4*a* are supported directly against those of the second guide vane stage 4*b*, the root plates 7 of the second guide vane state 4*b* are supported directly against those of the third guide vane stage 4*c*, and the root plates 7 of the third guide vane stage 4*c* are supported directly against those of the fourth guide vane stage 4*d*. Correspondingly, the root plates 7 of the guide vanes 5 of the first to third guide vane stages 4*a* to 4*c* are each retained on the guide vane carrier 2, on the one hand, and on at least one root plate 7 of a guide vane 5 of an adjacently arranged guide vane stage, on the other hand.

The above-described construction is distinguished in particular by the fact that the guide vanes 5 are retained directly on the guide vane carrier 2 and are retained directly on one another, and in that the root plates 7 exclusively define the radially outer walls of the flow path. Correspondingly, the construction dispenses with additional intermediate rings or the like, as a result of which it obtains a very simple and cost-effective structure. Owing to the above-described formation and arrangement of the guide vane carrier 2 and the guide vane stages 4*a* to 4*d*, the guide vane stages 4*a* to 4*d* have to be mounted in order in a predefined sequence during the assembly of the turbomachine 1, starting with the guide vanes 5 of the fourth guide vane stage 4*d*, which guide vanes are connected fixedly to the guide vane carrier 2. The installation of the guide vanes 5 of the third guide vane stage 4*c* can be started only after full mounting of the fourth guide vane stage 4*d*, whereupon then the mounting of the guide vanes of the second guide vane stage 4*b*, and then the mounting of the guide vanes of the first guide vane stage 4*a*, can follow. During the disassembly of the turbomachine 1, it is necessary for the guide vane stages 4*a* to 4*d* to be removed one after the other in the reverse sequence, starting with the guide vanes 5 of the first guide vane stage 4*a*. If, for example, only guide vanes 5 of the guide vane stages 4*b*, 4*c* and/or 4*d* are overhauled during maintenance and/or repair work, a very large amount of work is involved since it is at least also necessary for the guide vanes 5 of the first guide vane stage 4*a* to be removed, even though these are not subject to the maintenance and/or repair work at all.

SUMMARY OF INVENTION

Proceeding from said prior art, it is an object of the present invention to provide a turbomachine having an alternative structure and an improved method for partially disassembling such a turbomachine, which method can be carried out in a simpler, quicker and more cost-effective manner.

In order to achieve said object, the present invention provides a turbomachine of the type mentioned in the introduction, which is characterized in that at least some of the securing elements are inaccessible from an outer side of the guide vane carrier and are positioned such that, in the maintenance state, they are able to be reached, and mounted and dismounted, by the maintenance personnel via the intermediate space. This has the major advantage that, with regard to the mounting and/or dismounting of the guide vanes of the individual guide vane stages, no particular sequence has to be adhered to since the securing elements are freely accessible at all times, whereby it is possible in particular for maintenance and/or repair work to be simplified, reduced and carried out at low cost.

The form fit between the root plates and the guide vane carrier is advantageously brought about by projections which project radially and/or axially from the root plates and which engage into associated circumferential grooves of the guide vane carrier. In this way, a simple structure is obtained.

The projections are advantageously formed in axial end regions of the root plates, which results in a stable construction.

According to a configuration of the present invention, at least the root plates of the guide vanes or the first or last guide vane stage each have two projections which are arranged axially spaced apart from one another and which engage into associated circumferential grooves of the guide vane carrier in a form-fitting manner and which secure the root plates against displacement in the radial direction.

Preferably, the securing elements, in particular all the securing elements, are formed by securing pins which are received in a recess formed on a root plate, on the one hand, and in a recess formed on the guide vane carrier, on the other hand, wherein advantageously at least one of the recesses is formed by a cylindrical bore. In this way, a very simple structure is obtained.

Advantageously, the axial component of a direction vector of the main direction of extent of each securing element, within a plane extending radially through the securing element, is larger than the radial component. In this way, particularly good accessibility of the securing elements is ensured, with the result that said elements can be installed and removed in a simple manner.

In order to achieve the object mentioned in the introduction, the present invention also provides a method for partially disassembling a turbomachine of the type mentioned in the introduction, which method is characterized in that the single guide vane stage whose guide vanes are dismounted is freely selectable. In other words, in comparison with the prior art described in the introduction, the method according to the invention is distinguished by the fact that, when dismounting guide vanes, it is not necessary to adhere to a specific sequence in relation to the guide vane stages. Correspondingly, maintenance and repair work at individual guide vanes or guide vane stages can be significantly simplified and reduced, which can involve considerable savings in cost.

According to a configuration of the present invention, the single guide vane stage whose guide vanes are dismounted is a guide vane stage which is arranged between the outermost guide vane stages.

Preferably, prior to the dismounting of the guide vane stage, a support device which keeps at least one of the adjacently arranged guide vane stages in position while the method is being carried out is mounted. Correspondingly, the possibility of the position of said adjacently arranged guide vane stage changing during the dismounting of the guide vane stage to be removed is prevented, this facilitating both the dismounting and the re-mounting.

Preferably, the support device is screwed or pinned to the at least one adjacently arranged guide vane stage which is to be kept in position, in particular to at least one head plate of one of the guide vanes of said guide vane stage, in order to ensure secure positioning.

BRIEF DESCRIPTION OF THE DRAWINGS

Further features and advantages of the present invention will become clear on the basis of the following description of a turbomachine according to an embodiment of the present invention with reference to the appended drawing, in which.

DETAILED DESCRIPTION OF INVENTION

Figure 3:
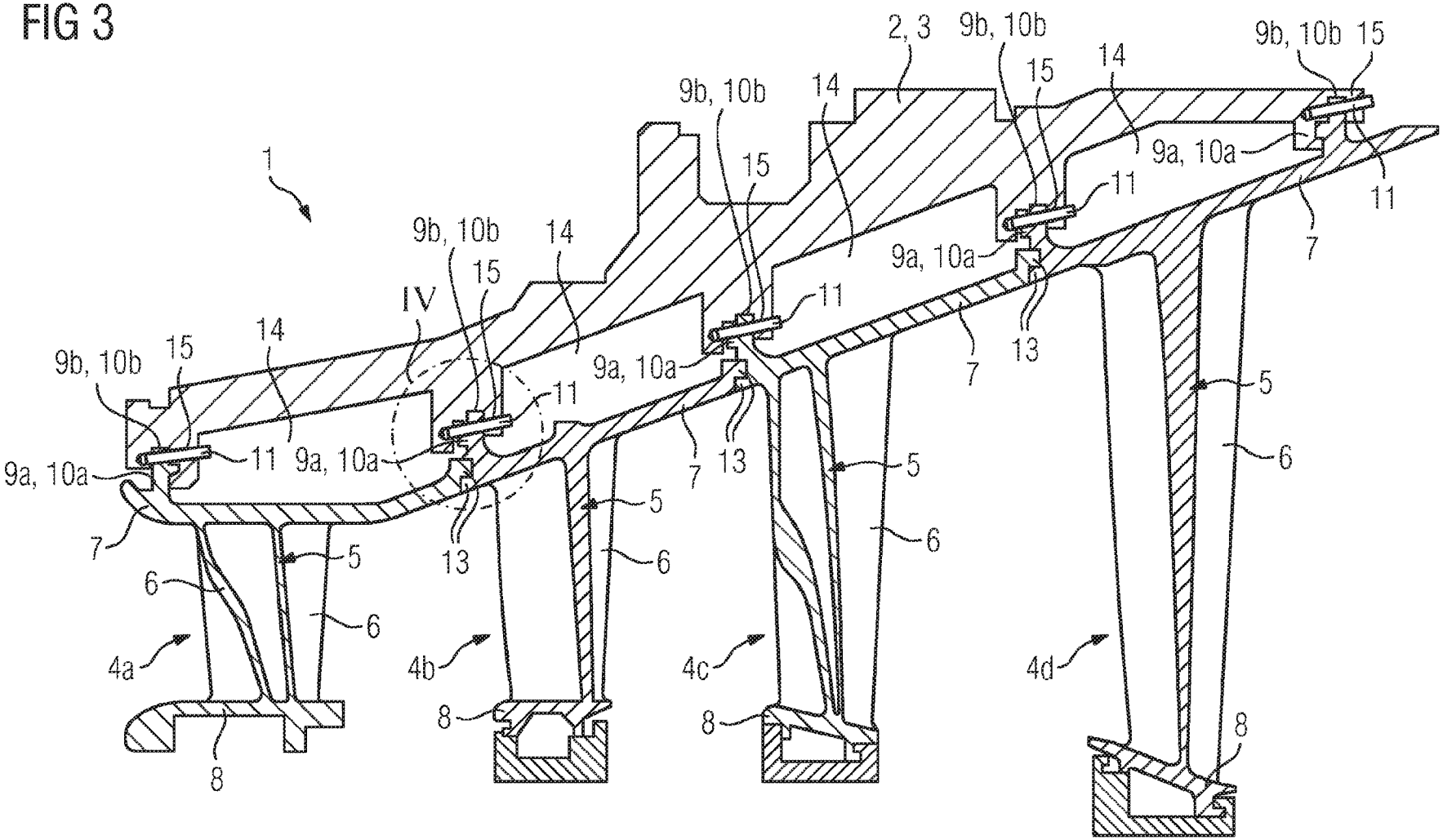
FIG. 3 shows a schematic cross sectional view of a sub-region of a turbomachine according to an embodiment of the present invention, with the upper part of a guide vane carrier removed and the rotor removed.

FIG. 3 shows a sectional view of a sub-region of a turbomachine 1 according to an embodiment of the present invention, with the upper part of a guide vane carrier 2 removed and the rotor already dismounted. The structure of the turbomachine 1 illustrated in FIG. 3 corresponds largely to the structure of the turbomachine 1 illustrated in FIG. 1 and already described above, and for this reason identical or similar components are denoted by identical reference designations and are not described again below.

Figure 1:
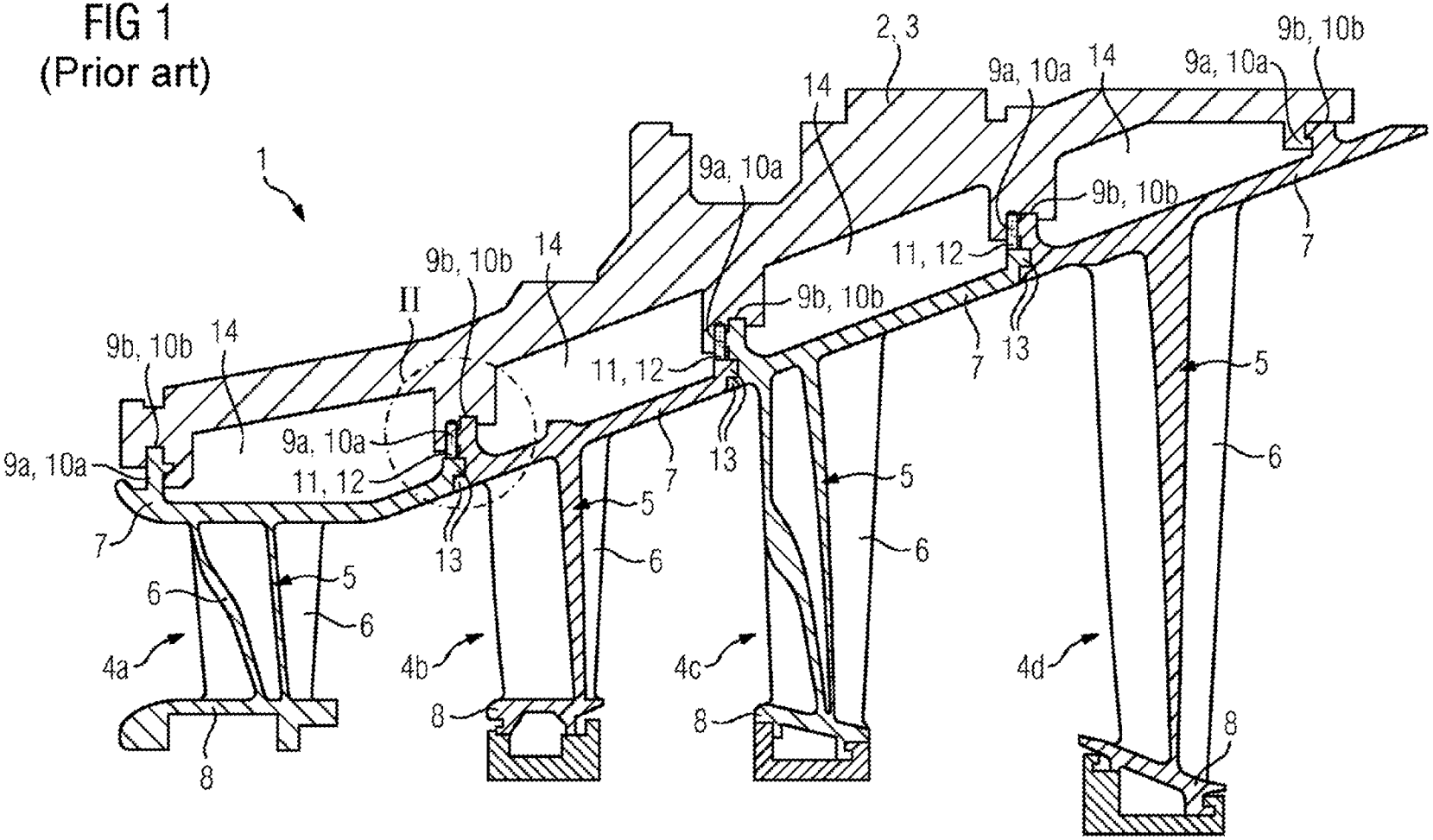
FIG 1 (Prior art)
FIG. 1 shows a schematic cross sectional view of a sub-region of a known turbomachine, with the upper part of a guide vane carrier removed and the rotor removed.
Figure 2:
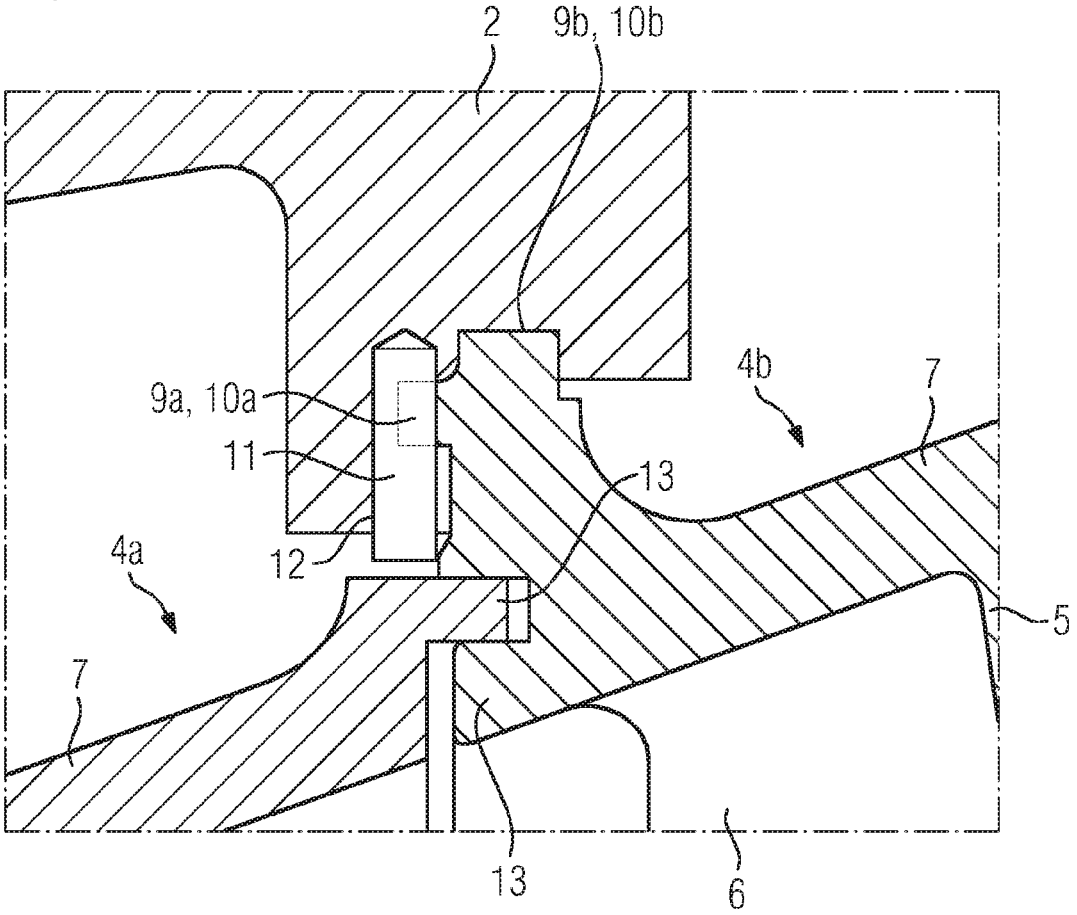
FIG. 2 shows an enlarged view of the detail identified in FIG. 1 by the reference designation II, which shows a known arrangement of a securing element.
Figure 4:
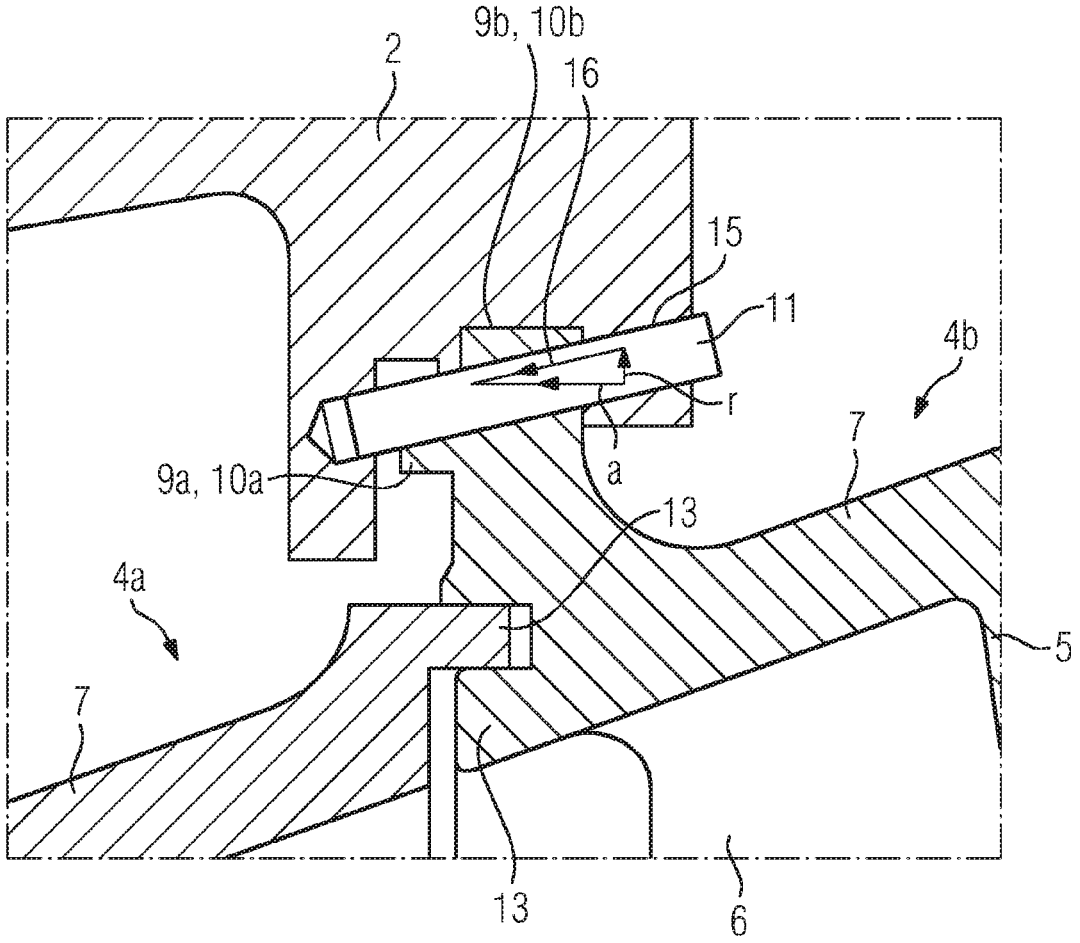
FIG. 4 shows an enlarged view of the detail identified in FIG. 3 by the reference designation IV, which shows an arrangement of a securing element.
Figure 5:
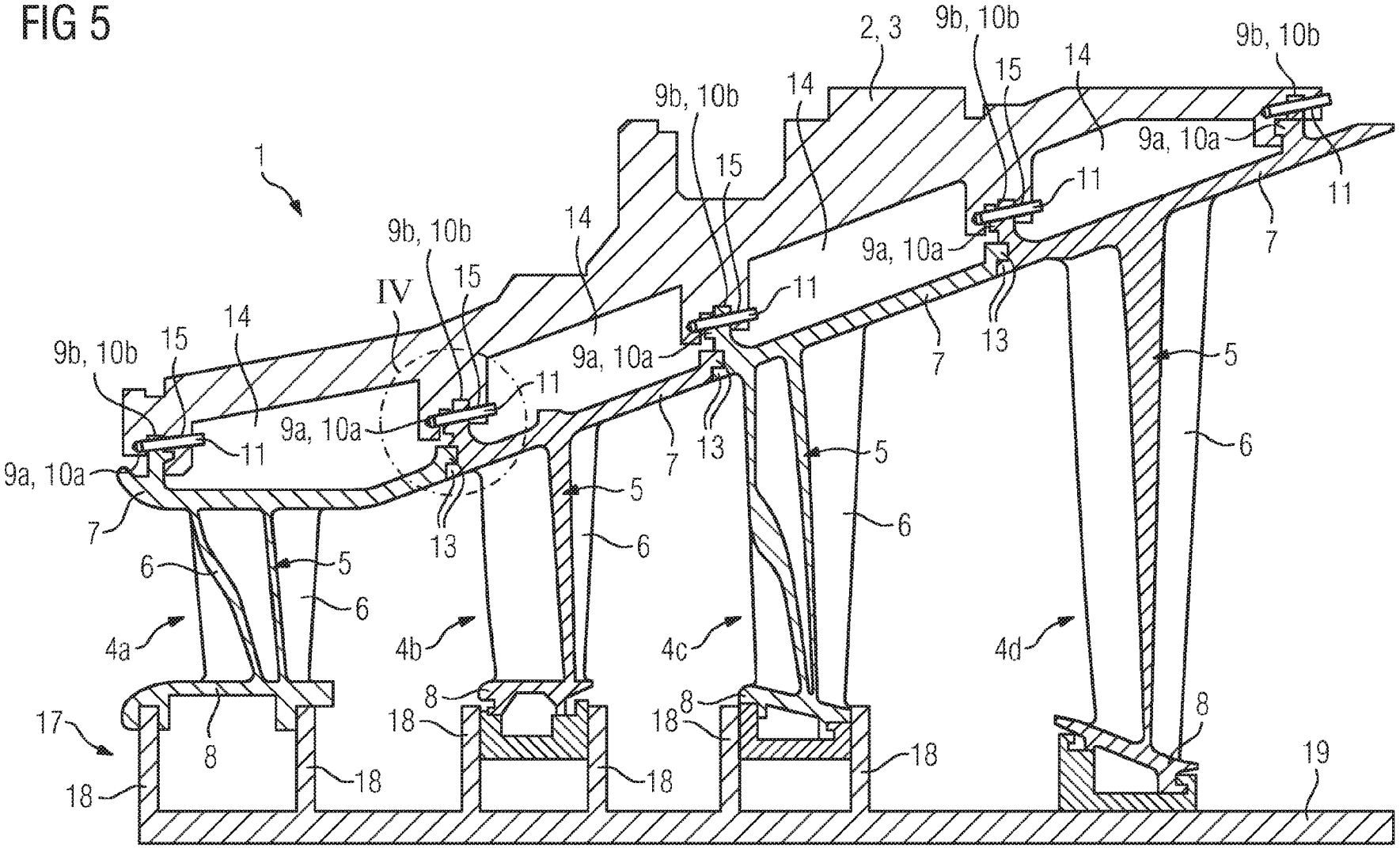
FIG. 5 shows a schematic cross sectional view of the turbomachine illustrated in FIG. 3, on which a support device is fastened.

A significant difference between the turbomachines 1 illustrated in FIGS. 1 and 3 is that the securing elements 11 in the turbomachine 1 according to the invention illustrated in FIG. 3 are positioned such that, following the removal of the upper part of the guide vane carrier 2, they are able to be accessed without any problems via intermediate spaces 14 which are present between the root plates 7 and the guide vane carrier 2 and, correspondingly, are able to be dismounted and re-mounted in a simple manner. More specifically, in the illustrated embodiment, the securing elements 11, which are formed by securing pins in the present case, are each received in a recess 15 formed on a root plate 7, on the one hand, and in a recess 15 formed on the guide vane carrier 2, on the other hand, which recesses, in the present case, are formed as bores which are aligned with one another. As is illustrated in particular in FIG. 4, said bores are oriented such that the axial component a of a direction vector 16 of the main direction of extent of each securing element 11, within a plane extending radially through the securing element 11, is greater than the radial component r. In the present case, the axial component a is approximately three times as large as the radial component r. Owing to such an orientation of the securing elements 11 in a substantially axial direction, it is possible for example for guide vanes 5 of the fourth guide vane stage 4*d* to be dismounted without having to remove the preceding guide vane stages 4*a* to 4*c* beforehand, as is schematically illustrated on the basis of FIG. 5. For this purpose, in a first step, the upper part of the guide vane carrier 2 and the rotor are removed, so that the guide vanes 5, provided in the lower part 3, are exposed. In a further step, a support device 17 is advantageously fastened at least on the third guide vane stage 4*c*, advantageously on the first three guide vane stages 4*a* to 4*c*, which support device engages around the respective head plates 8 of the guide vanes 5 of the first three guide vane stages 4*a* to 4*c* (see FIG. 5). In the present example, the support device 17 has ring segment-shaped support elements 18 which project radially outwardly from a base element 19 and which in each case receive between them the head plates 8 of a guide vane stage 4*a*, 4*b* or 4*c*. The support elements 18 may be mechanically connected to, or braced by way of, the head plates 8, for example through the use of corresponding screws or pins, even if this is not absolutely necessary. In a further step, it is possible for the securing elements 11 of a guide vane 5 of the fourth guide vane stage 4, which guide vane is arranged at the very top, to be detached, whereupon the corresponding guide vane 5 can be removed. For this purpose, the retaining projections 9*a* and 9*b* of the root plate 7 of the guide vane 5 are moved in the circumferential direction and, in this way, brought out of engagement with the associated ring-shaped grooves 10*a* and 10*b*. During the removal of the guide vanes 5 of the fourth guide vane stage 4*d*, the support device 17 ensures that the positioning of the guide vanes 5 of the adjacent guide vane stage 4*c* is maintained despite the fact that the engagement between the overlapping projections 13 is released. In this way, problem-free dismounting and re-mounting of the guide vanes 5 of the fourth guide vane stage 4*d* is ensured.

It should be clear that it is also possible, in an analogous manner, for the guide vanes 5 of the other guide vane stages 4*a* to 4*c* to be individually dismounted and re-mounted without the removal of adjacent guide vane stages being necessary for this purpose.

Even though the invention has been illustrated and described in more detail by way of the preferred exemplary embodiment, the invention is not restricted by the examples disclosed, and other variations may be derived therefrom by a person skilled in the art without departing from the scope of protection of the invention.

LIST OF REFERENCE SIGNS

1 Turbomachine
2 Guide vane carrier
3 Lower part
4*a* to *d* Guide vane stages
5 Guide vane
6 Guide vane airfoil
7 Root plate
8 Head plate
9*a,b* Retaining projection
10*a,b* Ring-shaped groove
11 Securing element
12 Recess
13 Overlapping projection
14 Intermediate space
15 Recess
16 Direction vector
17 Support device
18 Support element
19 Base element

The invention claimed is:

1. A turbomachine comprising:

a guide vane carrier of ring-shaped form, which is composed at least of a lower part and an upper part which is connected releasably to the latter, and at least three guide vane stages, which are retained on an inner circumference of the guide vane carrier and are arranged axially one behind the other in a flow direction and each have a multiplicity of substantially radially extending guide vanes, wherein each guide vane comprises a guide vane airfoil which extends between a root plate and a head plate, wherein each root plate is retained directly on the guide vane carrier in a form-fitting manner and, in this way, secured against displacement in a radial direction and an axial direction, wherein at least some root plates of the multiplicity of substantially radially extending guide vanes of each guide vane stage are secured against displacement in a circumferential direction by at least one additional securing element with a direction vector that comprises both a radial component and an axial component that are greater than zero, wherein the root plates of adjacently arranged guide vanes of axially adjacent guide vane stages in each case engage directly into one another in a form-fitting manner and partially overlap one another, wherein remaining between the root plates of each guide vane stage and the inner side of the guide vane carrier is in each case a substantially ring-shaped intermediate space which is accessible for maintenance personnel in a maintenance state in which the lower part and the upper part of the guide vane carrier are separate from one another, and wherein at least one securing element of the at least one additional securing element is inaccessible from an outer side of the guide vane carrier and is positioned such that, in the maintenance state, it is able to be reached, mounted, and dismounted, by the maintenance personnel via the intermediate space.

2. The turbomachine as claimed in claim 1, wherein a form fit between the root plates and the guide vane carrier is brought about by projections which project at least one of radially and axially from the root plates and which engage into associated circumferential grooves of the guide vane carrier.

3. The turbomachine as claimed in claim 2, wherein the projections are formed in axial end regions of the root plates.

4. The turbomachine as claimed in claim 2, wherein at least the root plates of guide vanes of a first or a last guide vane stage of the at least three guide vane stages each have two projections which are arranged axially spaced apart from one another and which engage into associated circumferential grooves of the guide vane carrier in the form-fitting manner and which secure the root plates against displacement in the radial direction.

5. The turbomachine as claimed in claim 1, wherein the at least one securing element of the at least one additional securing element is formed by a securing pin which is received in a recess formed on the root plate and in a recess formed on the guide vane carrier.

6. The turbomachine as claimed in claim 5, wherein at least one of the recess formed on the root plate and the recess formed on the guide vane carrier is formed by a cylindrical bore.

7. The turbomachine as claimed in claim 1, wherein the axial component of the direction vector of a main direction of extent of each securing element, within a plane extending radially through the securing element, is greater than the radial component.

8. The turbomachine as claimed in claim 7, wherein the axial component is two to four times as large as the radial component.

9. A method for partially disassembling a turbomachine, wherein the turbomachine comprises a guide vane carrier, which is composed at least of a lower part and an upper part, and comprises at least three guide vane stages of ring-shaped form, which are retained on an inner circumference of the guide vane carrier and are arranged axially one behind the other in a flow direction, the method comprising:

removing the upper part of the guide vane carrier, and dismounting guide vanes of a single guide vane stage of the at least three guide vane stages from the guide vane carrier, wherein the single guide vane stage whose guide vanes are dismounted is freely selectable, and wherein, prior to the dismounting of the guide vane stage, a support device which keeps at least one adjacently arranged guide vane stage of the at least three guide vane stages in position while the method is being carried out is mounted.

10. The method as claimed in claim 9, wherein the single guide vane stage whose guide vanes are dismounted is a guide vane stage which is arranged between the outermost guide vane stages of the at least three guide vane stages.

11. The method as claimed in claim 9, wherein the support device is screwed or pinned to the at least one adjacently arranged guide vane stage.

12. The turbomachine as claimed in claim 5, wherein all securing elements of the at least one additional securing element are formed by securing pins.

13. The method as claimed in claim 9, wherein the at least three guide vane stages of the turbomachine each comprise a multiplicity of substantially radially extending guide vanes, wherein each guide vane of the multiplicity of substantially radially extending guide vanes comprises a guide vane airfoil which extends between a root plate and a head plate, wherein each root plate is retained directly on the guide vane carrier in a form-fitting manner and, in this way, secured against displacement in a radial direction and an axial direction, wherein at least some root plates of guide vanes of each guide vane stage of the at least three guide vane stages are secured against displacement in a circumferential direction by at least one additional securing element, wherein the root plates of adjacently arranged guide vanes of axially adjacent guide vane stages of the at least three guide vane stages in each case engage directly into one another in a form-fitting manner and partially overlap one another, wherein remaining between the root plates of each guide vane stage of the at least three guide vane stages and an inner side of the guide vane carrier is in each case a substantially ring-shaped intermediate space which is accessible for maintenance personnel in a maintenance state in which the lower part and the upper part of the guide vane carrier are separate from one another, and wherein at least one securing element of the at least one additional securing element is inaccessible from an outer side of the guide vane carrier and is positioned such that, in the maintenance state, it is able to be reached, and mounted and dismounted, by the maintenance personnel via the intermediate space.

14. The turbomachine as claimed in claim 5, wherein the recess formed on the root plate and the recess formed on the guide vane carrier align to form a blind recess configured to receive a respective securing element, and wherein an inlet of the blind recess is disposed in a downstream-facing surface of the guide vane carrier with respect to a flow of working fluid in past the multiplicity of substantially radially extending guide vanes.

15. The turbomachine as claimed in claim 14, wherein the recess formed on the guide vane carrier comprises a through-portion and a blind portion that is separated by a gap from the through-portion, and wherein the blind recess comprises the inlet, then the through-portion, then the recess formed on the root plate which is disposed in the gap, and then the blind portion.

* * * * *